US005318291A

United States Patent [19]

Levatino

[11] Patent Number: 5,318,291

[45] Date of Patent: Jun. 7, 1994

[54] BASEBALL TRAINING METHOD

[76] Inventor: Samuel R. Levatino, 3608 Woodland Ridge Blvd., Baton Rouge, La. 70816

[21] Appl. No.: 49,113

[22] Filed: Apr. 19, 1993

Related U.S. Application Data

[60] Division of Ser. No. 863,087, Apr. 3, 1992, Pat. No. 5,226,646, which is a continuation-in-part of Ser. No. 824,526, Jan. 23, 1992, Pat. No. 5,228,684.

[51] Int. Cl.[5] ..... A63B 69/40

[52] U.S. Cl. ..... 273/26 R

[58] Field of Search ..... 273/26 R, 26 B, 29 A, 273/191 R, 184 B, 181 J, 185 D; 482/107, 91

[56] References Cited

U.S. PATENT DOCUMENTS

| | | | |
|---|---|---|---|
| 3,937,464 | 2/1976 | Zalewski | 273/26 R |
| 4,034,991 | 7/1973 | Oppenheimer | 273/186 A |
| 4,577,862 | 3/1986 | Segedahl | 273/26 R |
| 4,592,545 | 6/1986 | Segedahl | 273/26 R |
| 4,842,270 | 6/1989 | Lange | 272/117 |
| 5,029,852 | 7/1991 | Gilfillan | 273/26 R |
| 5,156,402 | 10/1992 | Hart | 273/26 R |

*Primary Examiner*—Theatrice Brown

*Attorney, Agent, or Firm*—Reginald F. Roberts, Jr.

[57] ABSTRACT

A method for training a baseball trainee in the art and science of batting a baseball. The method comprises (a) simulating the ideal swing of a baseball bat, and (b) communicating to the brain of the trainee the muscular sensations felt by the trainee during the simulated ideal swing.

3 Claims, 6 Drawing Sheets

BASEBALL TRAINING METHOD

CROSS-REFERENCE TO RELATED APPLICATION

This is a division of application Ser. No. 863,087, filed Apr. 3, 1993, now U.S. Pat. No. 5,226,646, which is a continuation-in-part of application Ser. No. 824,526, filed Jan. 23, 1992, now U.S. Pat. No. 5,228,684.

BACKGROUND OF THE INVENTION

The present invention relates to baseball training. More particularly, the invention relates to a method for training a baseball trainee in the art and science of batting a baseball.

At present the training available for properly and expertly batting a baseball is restricted to either manual instruction or mechanical devices which are constructed and designed to teach by rote memory or by trial and error. There does not exist in the prior art any device which allows the trainee to actually feel the way he or she should swing a baseball bat for maximum advantage. But it is virtually impossible to teach the trainee efficiently by either prior-art method. What is needed is a method which will simulate the ideal swing, and which will simultaneously communicate this simulation as a feeling to the trainee. The present invention provides such a machine.

SUMMARY OF THE INVENTION

In general, the present invention in one respect provides a method for training a baseball trainee. The method comprises (a) simulating the ideal swing of a baseball bat, and (b) communicating to the brain of the trainee the muscular sensations felt by the trainee during the simulated ideal swing.

In a second aspect the present invention provides a method for measuring batting power. The method comprises:

(a) Providing a training bat comprising a straight, rigid, elongated member having first and second ends. The first end of the elongated member is constructed and arranged to function as a handle for the trainee. The second end of the elongated member is constructed and arranged to function as a bathead.

(b) Providing a constrained path for the bathead to follow as the bat is swung by the trainee.

(c) Providing a measured resistance to the movement of the bathead along the constrained path.

(d) Providing means for stopping the bathead at the end of the swing.

(e) Measuring the time that has elapsed between the instant that the bathead starts to move until the instant the bathead is stopped.

(f) Measuring the distance travelled by the bathead along the constrained path.

(g) Calculating the power of the swing as the ratio of the product of the distance and the resistance to the elapsed time.

In a third aspect the invention provides a method for disengaging bat path directional movement, and for forcefully redirecting said movement along a straight line. The method comprises:

(a) Providing a training bat comprising a straight, rigid, elongated member having first and second ends. The first end of the elongated member is constructed and arranged to function as a handle for a baseball trainee. The second end of the elongated member is constructed and arranged to function as a bathead.

(b) Providing a constrained straight path for the bathead to follow as the training bat is swung by the trainee.

In a fourth aspect the invention provides a method for increasing the batting strength of a baseball trainee. The method comprises:

(a) Providing a training bat comprising a straight, rigid, elongated member having first and second ends. The first end of the elongated member is constructed and arranged to function as a handle for the trainee. The second end of the elongated member is constructed and arranged to function as a bathead.

(b) Providing a constrained straight path for the bathead to follow as the training bat is swung by the trainee.

(c) Providing a measured resistance to the movement of the bathead along the constrained path.

(d) Increasing the resistance to movement as training progresses, thereby increasing the batting strength of the trainee.

The above-described training method takes the bathead along a path which it has never before taken; viz., the shortest distance to a simulated baseball, thereby completely eliminating any vestiges of a sweeping or curvilinear arc, thus shortening and speeding the swing. The brain of the trainee could never, except after undergoing this training, command his or her muscles to do this, because the feeling is totally new, unnatural, and awkward, and because it has never been experienced before. However, upon feeling and experiencing it, the brain can easily remember this and command the muscles to duplicate this movement, which upon repetition becomes an habitual, simple, passive, subconscious muscle-memory reflex action. The present training method bypasses, eliminates, and makes unnecessary a lengthy, time-consuming and grossly-inefficient effort at attempting to teach the ideal batting swing through an active, conscious thought process which attempts to imitate this movement, and produces the shortest, most powerful route to full extension.

DETAILED DESCRIPTION OF THE INVENTION

Figure 1:
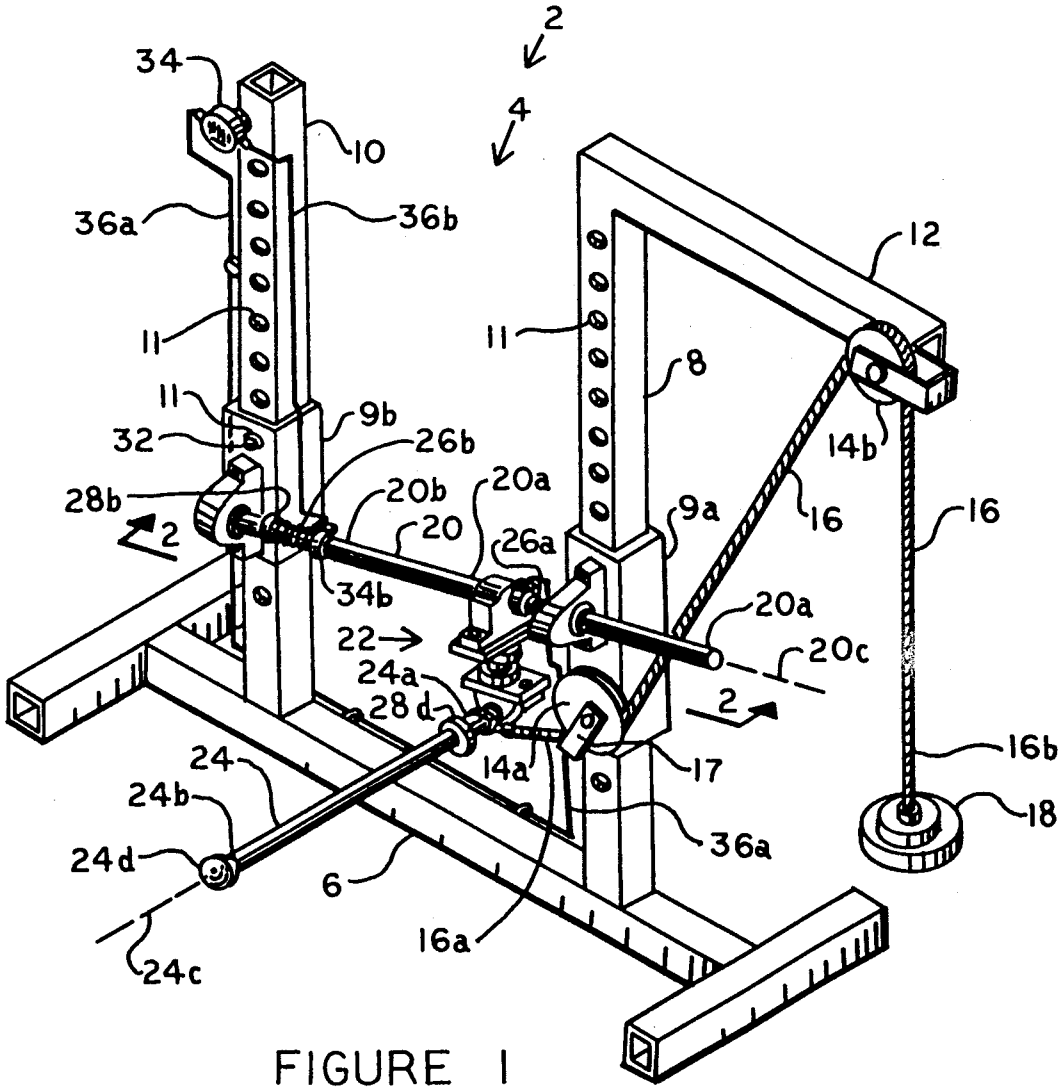
FIG. 1 is a schematic representation of a first embodiment of a baseball training machine, made in accordance with the principles of the present invention.
Figure 2:
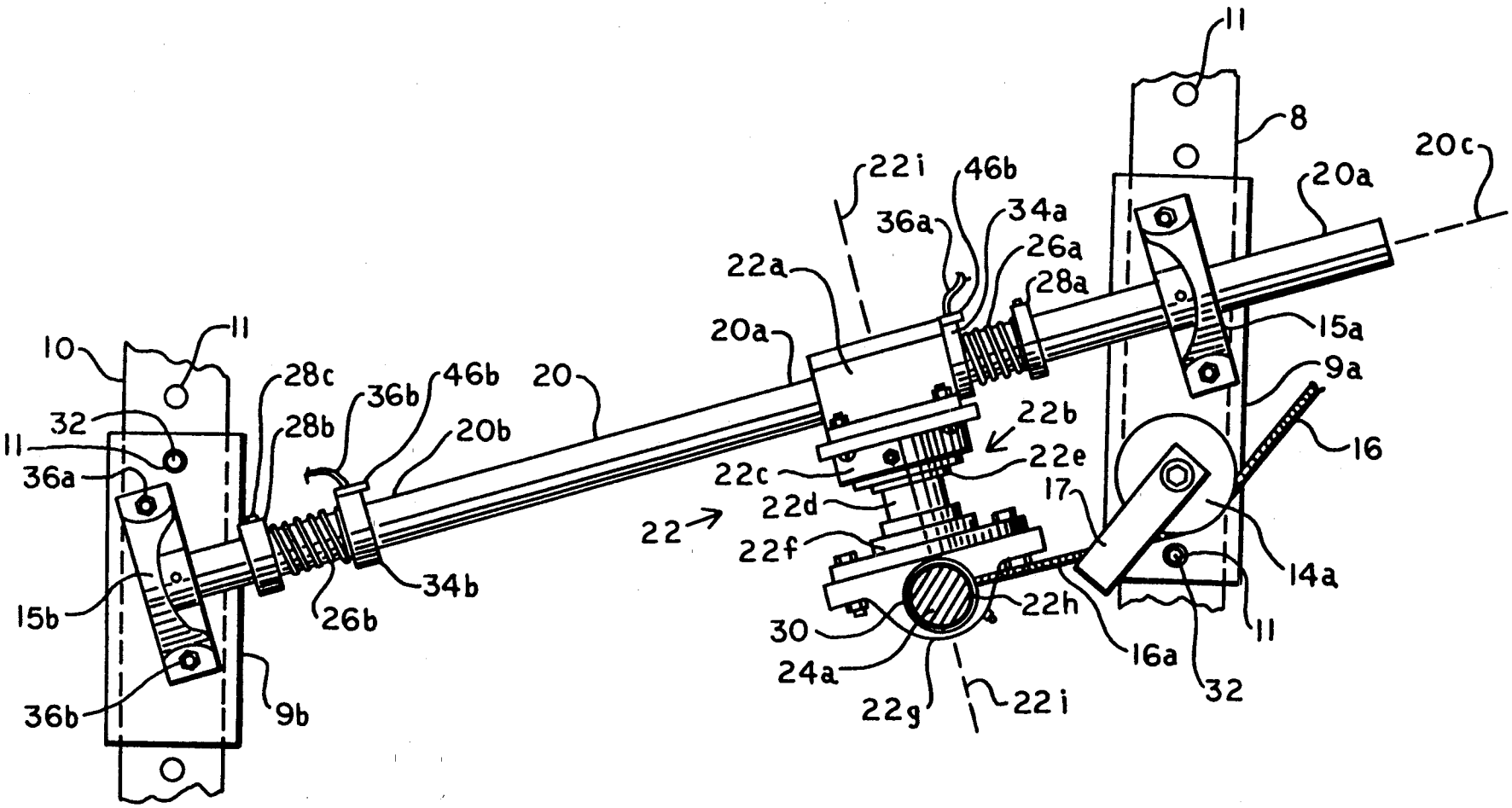
FIG. 2 is a partial cross-sectional view of the machine shown in FIG. 1, taken along the cutting line 2—2.

More specifically, reference is made to FIGS. 1 and 2, in which is shown a first embodiment of a baseball training machine, made in accordance with the principles of the present invention, and generally designated by the numeral 2.

The training machine 2 includes a frame 4 having a horizontal base 6, first and second perforated vertical members 8 and 10, and a horizontal arm 12 extending from the first vertical member 8.

First and second perforated sheaths 9*a* and 9*b* surround the first and second vertical members 8 and 10 over part of the lengths of the vertical members. Perforations 11 in the vertical members 8 and 10 are alignable with perforations 11 in the sheaths 9*a* and 9*b*, whereby the sheaths 9*a* and 9*b* may be fixed at a particular elevation, as hereinafter described.

First and second flexible pillow block bearings 15*a* and 15*b* are fastened to the first and second sheaths 9*a* and 9*b*. An adjustable elongated and rigid cross-member 20 has first and second ends 20*a* and 20*b* which define a longitudinal axis 20*c*. The adjustable cross-member 20 is preferably cylindrical. The first end 20*a* of the adjustable cross-member 20 is disposed in and supported by the first pillow block bearing 15*a*; the second end 20*b* of the adjustable cross-member 20 is disposed in and supported by the second pillow block bearing 15*b*. The first and second pillow block bearings 15*a*, 15*b* and the cross-member 20 are so constructed and arranged that the cross-member 20 is capable of rotation in the pillow block bearings 15*a*, 15*b* about the longitudinal axis 20*c* of the adjustable cross-member 20.

First and second annular stop members 28*a*, 28*b* and first and second springs 26*a*, 26*b* are mounted on the adjustable cross-member 20. Between the first and second springs 26*a* and 26*b* a kinetic adapter 22 is slideably and rotateably mounted on the cross-member 20. A training bat comprising a straight, rigid, elongated member 24 having first and second ends 24*a*, 24*b* is journalled in the kinetic adapter 22. The first end 24*a* of the training bat 24 is attached to the kinetic adapter 22, and the second end 24*b* serves as a handle for the training bat. A knob 24*d* of rubber or the like beneficially protects the second end 24*b* of the training bat 24. The first and second ends 24*a* and 24*b* define a longitudinal axis 24*c* of the training bat 24. The training bat 24 is preferably cylindrical.

A cable 16 having first and second ends 16*a*, 16*b* is disposed in first and second low-friction ball-bearing pulleys 14*a* and 14*b*. The first pulley 14*a* is mounted on the first sheath 9*a*; the second pulley 14*b* is mounted on the horizontal arm 12. The first end 16*a* of the cable 16 is connected to the first end 24*a* of the bat 24. An adjustable weight 18 is attached to the second end 16*b* of the cable 16.

The pillow block bearings 15*a* and 15*b* are fastened to the sheaths 9*a* and 9*b* by nuts 30*a* and bolts 30*b*. The stop members 28*a* and 28*b* are secured to the adjustable cross-member 20 by Allen screws 28*c* which, when loosened, allow the members 28*a* and 28*b* to slide along the cross-member 20 and be refastened at any point along the cross-member.

Figure 3:
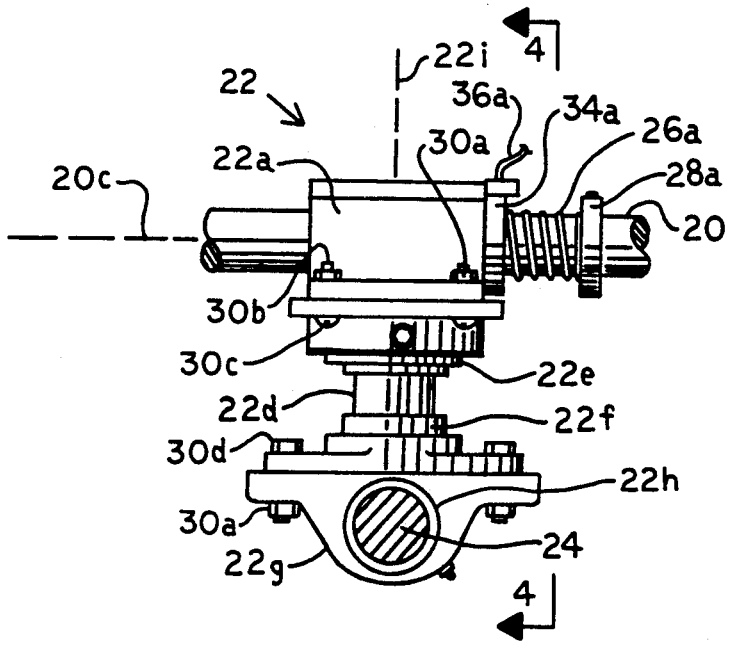
FIG. 3 is an enlarged view of a portion of the training machine shown in FIG. 2.
Figure 4:
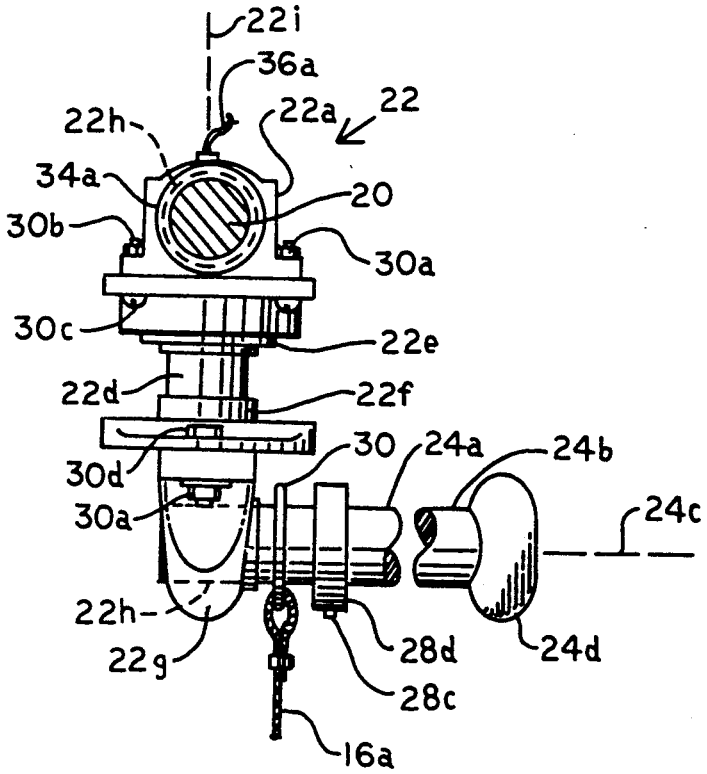
FIG. 4 is a cross-sectional view of the portion of the machine shown in FIG. 3, taken along the cutting line 4—4.

Reference is now made to FIGS. 3 and 4, in which is shown the detailed structure of the kinetic adapter 22 and of the attachment of the cable 16 to the training bat 24.

The kinetic adapter 22 comprises a linear ball bearing 22*a*, a first rotary flange bearing 22*e*, a connecting member 22*d* having a rotational axis 22*i*, a second rotary flange bearing 22*f*, and a third flexible pillow block bearing 22*g*. The first rotary flange bearing 22*e* is fastened to the linear ball bearing 22*a* by nuts 30*a* and bolts 30*b*, 30*c*. The connecting member 22*d* enables the second rotary flange bearing 22*e* and the third flexible pillow block bearing 22*g* to rotate about the axis 22*i*. The third flexible pillow block bearing 22*g* is fastened to the second rotary flange bearing 22*f* with nuts 30*a* and bolts 30*d*. The third flexible pillow block bearing 22*g* includes an opening 22*h* for the disposal therein of the first end 24*a* of the training bat 24. The opening 22*h* defines a rotational axis which is identical with the longitudinal axis 24*c* of the bat 24. The linear ball bearing 22*a*, first and second rotary flange bearings 22*e* and 22*f*, connecting member 22*d*, and third flexible pillow block bearing 22*g* cooperate with one another to provide for the training bat 24 freedom of movement, both linear and rotational, in three dimensions and in an infinite number of planes.

The first end 16*a* of the cable 16 is secured to the first end 24*a* of the bat 24 by a ring 30 which encircles the first end 24*a* of the bat 24. The ring 30 is confined to the first end 24*a* of the bat 24 by a third annular stop member 28*d*. The third stop member 28*d* is adjustably attached to the first end 24*a* of the bat 24 by an Allen screw 28*c*.

Figure 5:
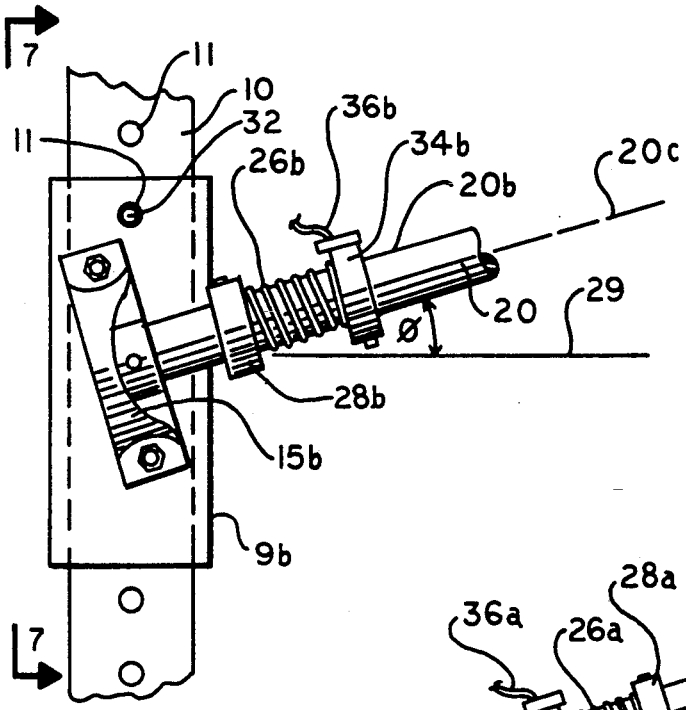
FIG. 5 is an enlarged view of a first portion of the machine shown in FIG. 1.
Figure 6:
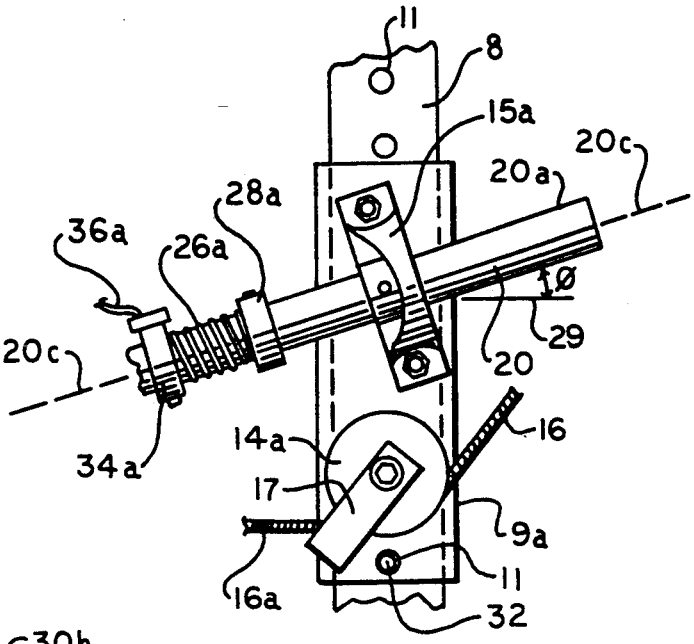
FIG. 6 is an enlarged view of a second portion of the machine shown in FIG. 1.

Reference is now made to FIGS. 5 and 6, in which are shown structural details of portions of the baseball training machine 2. The adjustable cross-member 20 defines an angle $\theta$ with a horizontal plane 29. The value of $\theta$ is from about forty degrees above the horizontal plane 29 to about forty degrees below the horizontal plane 29. Preferably, the value of $\theta$ is from about twenty degrees above to about twenty degrees below the horizontal plane 29.

Figure 7:
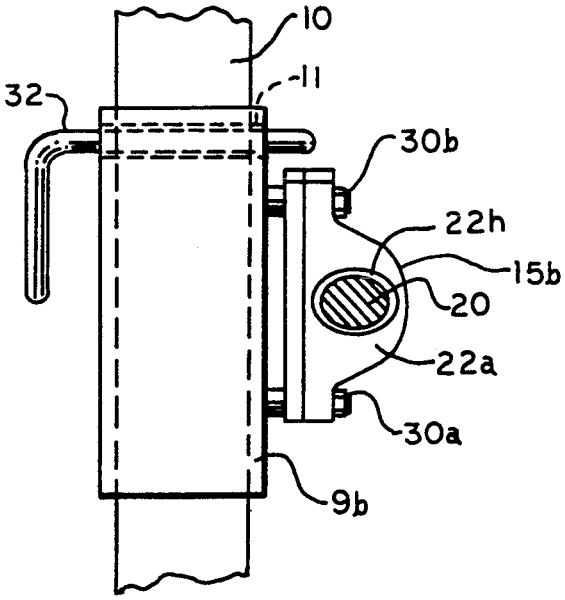
FIG. 7 is a cross-sectional view of the first portion of the machine shown in FIG. 5, taken along the cutting line 7—7.

Reference is now made to FIG. 7, in which are shown structural details of the manner of attachment of the second sheath 9*b* to the second vertical member 10. The elevation of the second sheath 9*b* is fixed by inserting a pin 32 through the aligned perforations 11 of the sheath 9*b* and the vertical member 10. In a similar manner the elevation of the first sheath 9*a* is fixed by inserting a second pin 32 through the aligned perforations 11 of the sheath 9*a* and the first vertical member 8. These two operations fix both the elevation and the inclination, as defined by the angle $\theta$, of the adjustable cross-member 20.

The length of the training bat 24 is from about twenty-eight to about thirty-eight inches, in order to simulate a regulation baseball bat, which has a length of thirty-four inches. Preferably, the length of the training bat 24 is from about thirty-two to about thirty-six inches.

The length of the adjustable cross-member 20 is from about three to about five feet.

The length of the vertical members 8 and 10 is from about four to about six feet.

Preferably, the vertical members 8 and 10 and the sheaths 9a and 9b are made from tubing. Even more preferably, they are made from square tubing.

The dimensions of the pillow block bearings 15a and 15b are preferably about one inch internal diameter (1" ID).

The perforations 11 in the sheaths 9a, 9b and the vertical members 8, 10 are from about three-eights to about three-fourths of an inch in breadth. Preferably, the perforations 11 are from about three-eighths to about one-half of an inch in breadth. Even more preferably, the perforations 11 are substantially circular.

The distance separating the individual perforations 11 from one another is from about three-fourths of an inch to about one and one-half inches.

While the inclination of the adjustable cross-member 20 may be horizontal or oblique, it is preferably oblique with a slight downward slope from the first vertical member 8 to the second vertical member 10, as shown in FIGS. 5 and 6.

The manner of operating and using the training machine 2 is generally as follows.

The trainee grasps the handle 24b of the training bat 24, and starts his or her swing. The start of the swing is determined by the position of the first spring 26a and the first stop member 28a. From this starting position, the kinetic adapter 22 travels on a path along the adjustable cross-member 20 until the adapter 22 strikes the second spring 26b and is stopped by the second stop member 28b, thereby ending the swing. This procedure eliminates the need for a totally separate drill in which a trainee hits a tire with a baseball bat.

Preferably, and referring to FIGS. 1 and 2, the period of the swing is measured by means of an automatic timer 34. A first electrical cord 36a electrically connects the timer 34 to a third stop member 34a. A second electrical cord 36b electrically connects the timer 34 to a fourth stop member 34b. Switching means 46a and 46b shown in FIG. 11 start and stop the timer 34 at the beginning and end of a swing by connecting and disconnecting the timer 34 from a source of electrical power 52.

Figure 10:
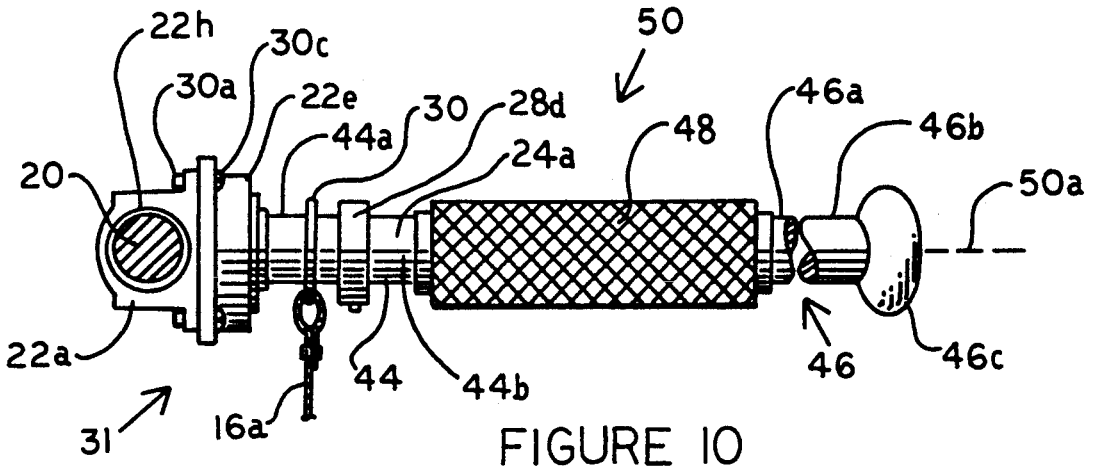
FIG. 10 is a schematic representation of a portion of a third embodiment of a baseball training machine, made in accordance with the principles of the present invention.

Reference is now made to FIG. 10, wherein is shown a portion of a second embodiment of a baseball training machine, made in accordance with the principles of the present invention. In the second embodiment of the training machine, a kinetic adapter 31 comprises a linear ball bearing 22a fastened to a rotary flange bearing 22e in a perpendicular configuration. The linear ball bearing 22a is slideably and rotatably mounted on the adjustable cross-member 20 (FIG. 1).

A first straight, rigid, elongated member 44 having first and second ends 44a, 44b has its first end 44a disposed in the rotary flange bearing 22e. A second straight, rigid, elongated member 46 has first and second ends 46a, 46b. A flexible member 48 connects the second end 44b of the first elongated member 44 to the first end 46a of the second elongated member 46 to form a training bat 50 having a longitudinal and rotational axis 50a. The second end 46b of the second elongated member 46 serves as a handle for the bat 50, and may beneficially terminate in a flange-like knob 46c.

The overall length of the training bat 50 is from about twenty-eight to about thirty-eight inches, in order to simulate a thirty-four-inch regulation baseball bat. Preferably, the length of the training bat 50 is from about thirty-two to about thirty-six inches. Even more preferably, the length of the first rigid elongated member 44 is less than that of the second rigid elongated member 46. The construction of the bat 50 and of the kinetic adapter 31 permits freedom of movement of the bat 50 in multiple planes.

The linear ball bearing 22a can move not only in a linear direction, but can also twist in a rotational direction. The rotary flange bearing 22e not only allows limited linear movement of the training bat 50, but also allows rotational movement of the bat within the bearing. Furthermore, the flexible member 48 maximizes freedom of movement of the wrists and arms while totally controlling the path of the first elongated member (bathead) 44.

The only difference between the first and second embodiments of the baseball training machine resides in the replacement of the kinetic adapter 22 and training bat 24 with the kinetic adapter 31 and the training bat 50. The remaining parts of the first embodiment 2 (FIG. 1) are unchanged.

Figure 8:
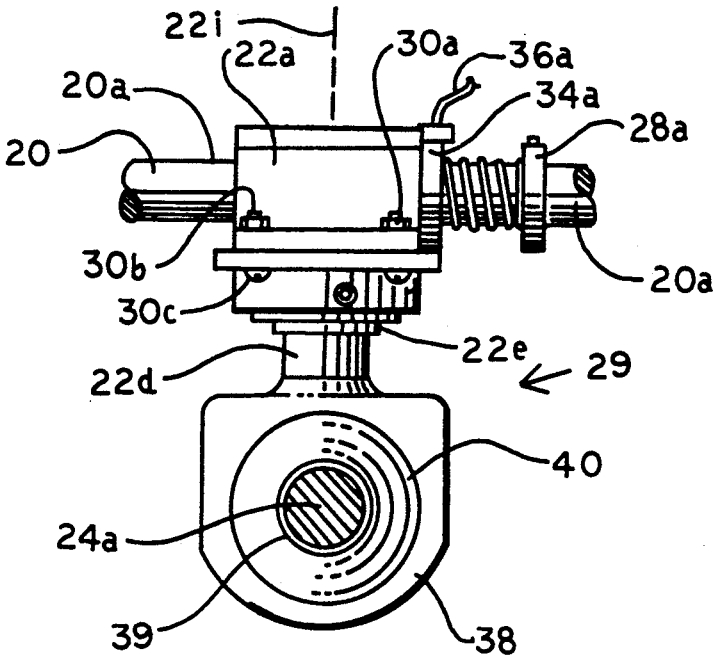
FIGS. 8 and 9 are schematic representations of a portion of a second embodiment of a baseball training machine, made in accordance with the principles of the present invention.
Figure 9:
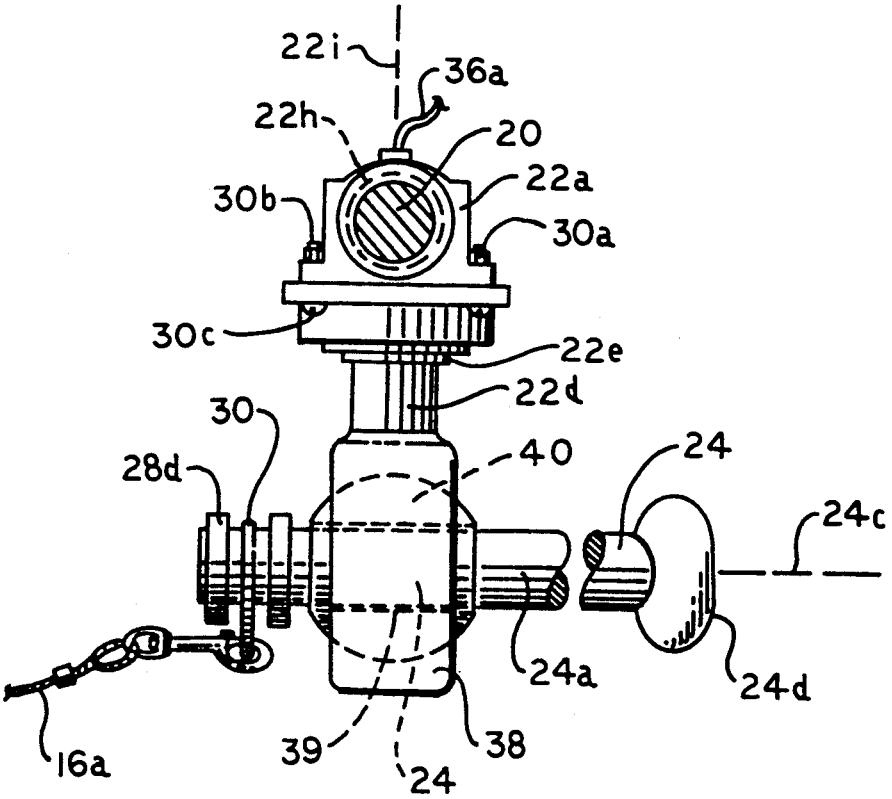

Reference is now made to FIGS. 8 and 9, in which is shown a portion of a third and most preferred embodiment of a baseball training machine, made in accordance with the principles of the present invention. In the third embodiment of the training machine, a kinetic adapter 29 is slidably and rotatably mounted on the adjustable cross-member 20 (FIG. 1). The kinetic adapter 29 comprises a linear ball bearing 22a, a rotary flange bearing 22e, and a rod-end spherical bearing 38. All of the bearings include flanges. The linear ball bearing 22a is slidably and rotatably mounted on the cross-member 20. The flange of the rotary flange bearing 22e is fastened to the flange of the linear ball bearing 22a, and the rod-end spherical bearing 38 is rotatably connected to the rotary flange bearing 22e by a connecting member 22d having an axis of rotation 22i. The rod-end spherical bearing 38 includes a ball 40 having therein a socket 39 for receiving the first end 24a of the training bat 24 used with the first embodiment 2 of the training machine (FIG. 1). The bat 24 is freely rotatable about its longitudinal axis 24c in the socket 39. The remaining parts of the first embodiment 2 (FIG. 1) are unchanged. The linear ball bearing 22a, rotary flange bearing 22e, connecting member 22d, and rod-end spherical bearing 38 cooperate with one another to provide for the training bat 24 freedom of movement, both linear and rotational, in three dimensions and in an infinite number of planes.

Figure 11:
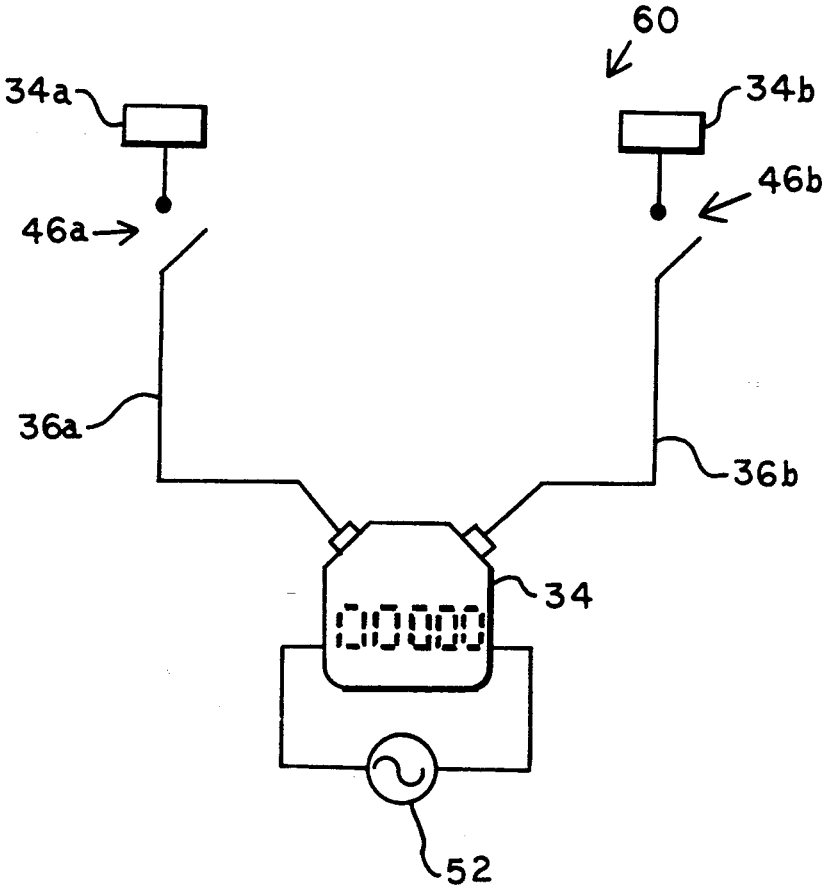
FIG. 11 is a wiring diagram of a timing mechanism made in accordance with the principles of the present invention.

Reference is now made to FIG. 11, in which is shown a wiring diagram of a timing mechanism made in accordance with the principles of the present invention, and generally designated by the numeral 60.

The timing mechanism 60 comprises the timer 34; the source of electrical power 51; the stop members 34a and 34b; the electrical cords 36a and 36b; and switches 46a and 46b. The source of electrical power 52 is preferably a 110–220 volt alternating current (110–120 VAC) outlet. It may, however, be an electrical storage battery.

The method encompassed by the present invention will now be illustrated by two examples. These examples are for the purpose of illustration only, and in no manner limit the scope of the present invention.

EXAMPLE I

Trainee A participated in a training course comprising twenty-five days' duration and six days of actual training, using the third embodiment of the training machine shown in FIGS. 1 and 10. The progress of the trainee during this course of training is illustrated by the data collected in Tables I–V.

EXAMPLE II

Trainee B participated in a training program comprising forty-three days' duration and eleven days of actual training, using the same training machine as did Trainee A of Example I. The dramatic improvement in performance of Trainee B during this course of training is shown by the representative data collected in Table VI.

TABLE I

| | Simulation: High Inside Zone | | | | |
|---|---|---|---|---|---|
| Day No. | Resistance (lb) | Time (sec) | Distance (ft) | Speed (ft/sec) | Power (ft-lb/sec) |
| 1 | 10 | 0.352 | 2.08 | 5.9 | 59 |
| 1 | 15 | 0.273 | 2.08 | 7.6 | 114 |
| Avg. | | | | (6.75) | (87) |
| 2 | 10 | 0.286 | 2.08 | 7.3 | 73 |
| 2 | 15 | 0.277 | 2.08 | 7.5 | 113 |
| 2 | 20 | 0.310 | 2.08 | 6.7 | 134 |
| Avg. | | | | (7.2) | (107) |
| 3 | 25 | 0.297 | 2.08 | 7.0 | 175 |
| 4 | 20 | 0.282 | 2.08 | 7.4 | 147 |
| 4 | 25 | 0.279 | 2.08 | 7.45 | 186 |
| Avg. | | | | (7.4) | (167) |
| 5 | 20 | 0.256 | 2.08 | 8.1 | 162 |
| 5 | 27.5 | 0.320 | 2.08 | 6.5 | 179 |
| 5 | 35 | 0.348 | 2.08 | 6.0 | 209 |
| Avg. | | | | (6.9) | (183) |
| 6 | 27.5 | 0.284 | 2.5 | 8.8 | 242 |
| 6 | 35 | 0.278 | 2.5 | 9.0 | 315 |
| Avg. | | | | (8.9) | (278) |

TABLE II

| | High Outside Zone | | | | |
|---|---|---|---|---|---|
| Day No. | Resistance (lb) | Time (sec) | Distance (ft) | Speed (ft/sec) | Power (ft-lb/sec) |
| 1 | 10 | 0.315 | 2.08 | 6.6 | 66 |
| 1 | 15 | 0.289 | 2.08 | 7.2 | 108 |
| Avg. | | | | (6.9) | (87) |
| 2 | 10 | 0.289 | 2.08 | 7.2 | 72 |
| 2 | 15 | 0.283 | 2.08 | 7.3 | 110 |
| 2 | 20 | 0.314 | 2.08 | 6.6 | 132 |
| Avg. | | | | (7.0) | (105) |
| 3 | 25 | 0.327 | 2.08 | 6.4 | 159 |
| 4 | 20 | 0.300 | 2.08 | 6.9 | 139 |
| 4 | 25 | 0.321 | 2.08 | 6.5 | 162 |
| Avg. | | | | (6.7) | (150) |
| 5 | 20 | 0.284 | 2.08 | 7.3 | 146 |
| 5 | 27.5 | 0.333 | 2.08 | 6.2 | 172 |
| 5 | 35 | 0.318 | 2.08 | 6.5 | 229 |
| Avg. | | | | (6.7) | (182) |
| 6 | 27.5 | 0.324 | 2.5 | 7.7 | 212 |
| 6 | 35 | 0.314 | 2.5 | 8.0 | 279 |
| Avg. | | | | (7.85) | (245) |

TABLE III

| | Low Inside Zone | | | | |
|---|---|---|---|---|---|
| Day No. | Resistance (lb) | Time (sec) | Distance (ft) | Speed (ft/sec) | Power (ft-lb/sec) |
| 1 | 10 | 0.269 | 2.08 | 7.7 | 77 |
| 1 | 15 | 0.289 | 2.08 | 7.2 | 108 |
| Avg. | | | | (7.45) | (92.5) |
| 2 | 10 | 0.330 | 2.08 | 6.3 | 63 |
| 2 | 15 | 0.292 | 2.08 | 7.1 | 107 |
| 2 | 20 | 0.266 | 2.08 | 7.8 | 156 |
| Avg. | | | | (7.1) | (109) |
| 3 | 20 | 0.280 | 2.08 | 7.4 | 149 |
| 3 | 25 | 0.299 | 2.08 | 7.0 | 174 |
| Avg. | | | | (7.2) | (161) |
| 4 | 20 | 0.273 | 2.08 | 7.6 | 152 |
| 4 | 25 | 0.300 | 2.08 | 6.9 | 173 |
| Avg. | | | | (7.25) | (163) |
| 5 | 20 | 0.249 | 2.08 | 8.4 | 167 |
| 5 | 27.5 | 0.296 | 2.08 | 7.0 | 193 |
| 5 | 35 | 0.334 | 2.08 | 6.2 | 218 |

TABLE III-continued

| | Low Inside Zone | | | | |
|---|---|---|---|---|---|
| Day No. | Resistance (lb) | Time (sec) | Distance (ft) | Speed (ft/sec) | Power (ft-lb/sec) |
| Avg. | | | | (7.2) | (193) |
| 6 | 27.5 | 0.300 | 2.5 | 8.3 | 229 |
| 6 | 35 | 0.302 | 2.5 | 8.3 | 290 |
| Av.g | | | | (8.3) | (259) |

TABLE IV

| | Low Outside Zone | | | | |
|---|---|---|---|---|---|
| Day No. | Resistance (lb) | Time (sec) | Distance (ft) | Speed (ft/sec) | Power (ft-lb/sec) |
| 1 | 10 | 0.350 | 2.08 | 5.9 | 59 |
| 1 | 15 | 0.317 | 2.08 | 6.6 | 98 |
| Avg. | | | | (6.25) | (79) |
| 2 | 10 | 0.330 | 2.08 | 6.3 | 63 |
| 2 | 15 | 0.287 | 2.08 | 7.2 | 109 |
| 2 | 20 | 0.302 | 2.08 | 6.9 | 138 |
| Avg. | | | | (6.8) | (103) |
| 3 | 15 | 0.318 | 2.08 | 6.5 | 98 |
| 3 | 25 | 0.332 | 2.08 | 6.3 | 157 |
| Avg. | | | | (6.4) | (127) |
| 4 | 20 | 0.273 | 2.08 | 7.6 | 152 |
| 4 | 24 | 0.300 | 2.08 | 6.9 | 173 |
| Avg. | | | | (7.25) | (163) |
| 5 | 20 | 0.315 | 2.08 | 6.6 | 132 |
| 5 | 27.5 | 0.324 | 2.08 | 6.4 | 177 |
| 5 | 35 | 0.345 | 2.08 | 6.0 | 211 |
| Avg. | | | | (6.3) | (173) |
| 6 | 27.5 | 0.300 | 2.5 | 8.3 | 229 |
| 6 | 35 | 0.302 | 2.5 | 8.3 | 290 |
| Avg. | | | | (8.3) | (259) |

TABLE V

| | "Down the Middle" | | | | |
|---|---|---|---|---|---|
| Day No. | Resistance (lb) | Time (sec) | Distance (ft) | Speed (ft/sec) | Power (ft-lb/sec) |
| 1 | 10 | 0.247 | 2.08 | 8.4 | 84 |
| 1 | 20 | 0.315 | 2.08 | 6.6 | 132 |
| 1 | 25 | 0.488 | 2.08 | 4.3 | 106 |
| Avg. | | | | (6.4) | (108) |
| 2 | 15 | 0.306 | 2.08 | 6.8 | 102 |
| 2 | 20 | 0.306 | 2.08 | 6.8 | 136 |
| Avg. | | | | (6.8) | (119) |
| 3 | 25 | 0.299 | 2.08 | 7.0 | 174 |
| 3 | 30 | 0.323 | 2.08 | 6.4 | 193 |
| Avg. | | | | (6.7) | (184) |
| 4 | 15 | 0.249 | 2.08 | 8.4 | 125 |
| 4 | 20 | 0.287 | 2.08 | 7.2 | 145 |
| 4 | 30 | 0.312 | 2.08 | 6.7 | 200 |
| 4 | 35 | 0.348 | 2.08 | 6.0 | 209 |
| Avg. | | | | (7.1) | (170) |
| 5 | 20 | 0.261 | 2.08 | 8.0 | 159 |
| 5 | 27.5 | 0.312 | 2.08 | 6.7 | 183 |
| Avg. | | | | (7.35) | (171) |
| 6 | 55 | 0.324 | 2.5 | 7.7 | 424 |
| 6 | 65 | 0.372 | 2.5 | 6.7 | 437 |
| 6 | 70 | 0.387 | 2.5 | 6.5 | 452 |
| Avg. | | | | (7.0) | (438) |

TABLE VI

| | "Down the Middle" | | | | |
|---|---|---|---|---|---|
| Day No. | Resistance (lb) | Time (sec) | Distance (ft) | Speed (ft/sec) | Power (ft-bl/sec) |
| 1 | 5 | 0.365 | 2.08 | 5.7 | 28 |
| 1 | 10 | 0.452 | 2.08 | 4.6 | 46 |
| 1 | 15 | 0.568 | 2.08 | 3.7 | 55 |
| 1 | 20 | 0.868 | 2.08 | 2.4 | 48 |
| Avg. | | | | (4.1) | (44) |
| 2 | 10 | 0.347 | 2.08 | 6.0 | 60 |
| 2 | 15 | 0.474 | 2.08 | 4.4 | 66 |
| 2 | 20 | 0.562 | 2.08 | 3.7 | 74 |
| Avg. | | | | (4.7) | (67) |

TABLE VI-continued

| Day No. | Resistance (lb) | "Down the Middle" Time (sec) | Distance (ft) | Speed (ft/sec) | Power (ft-bl/sec) |
|---|---|---|---|---|---|
| 3 | 10 | 0.287 | 2.08 | 7.2 | 72 |
| 3 | 20 | 0.321 | 2.08 | 6.5 | 130 |
| 3 | 25 | 0.351 | 2.08 | 5.9 | 148 |
| Avg. | | | | (6.5) | (117) |
| 4 | 15 | 0.297 | 2.08 | 7.0 | 105 |
| 4 | 20 | 0.324 | 2.08 | 6.4 | 128 |
| Avg. | | | | (6.7) | (117) |
| 5 | 15 | 0.293 | 2.08 | 7.1 | 106 |
| 6 | 25 | 0.371 | 2.08 | 5.6 | 140 |
| 7 | 15 | 0.297 | 2.08 | 7.0 | 105 |
| 7 | 20 | 0.309 | 2.08 | 6.7 | 135 |
| Avg. | | | | (6.85) | (120) |
| 8 | 40 | 0.387 | 2.08 | 5.4 | 215 |
| 8 | 45 | 0.390 | 2.08 | 5.3 | 240 |
| 8 | 50 | 0.474 | 2.08 | 4.4 | 219 |
| Avg. | | | | (5.0) | (225) |

TABLE VI

| Day No. | Resistance (lb) | (concluded) Time (sec) | Distance (ft) | Speed (ft/sec) | Power (ft-bl/sec) |
|---|---|---|---|---|---|
| 9 | 40 | 0.273 | 2.5 | 9.2 | 366 |
| 9 | 50 | 0.327 | 2.5 | 7.6 | 382 |
| 9 | 55 | 0.357 | 2.5 | 7.0 | 385 |
| 9 | 60 | 0.381 | 2.5 | 6.6 | 394 |
| 9 | 65 | 0.501 | 2.5 | 5.0 | 324 |
| 9 | 70 | 0.405 | 2.5 | 6.2 | 432 |
| Avg. | | | | (6.9) | (380) |
| 10 | 35 | 0.246 | 2.5 | 10.2 | 356 |
| 10 | 40 | 0.282 | 2.5 | 8.9 | 355 |
| 10 | 45 | 0.261 | 2.5 | 9.6 | 431 |
| 10 | 50 | 0.297 | 2.5 | 8.4 | 421 |
| 10 | 55 | 0.312 | 2.5 | 8.0 | 441 |
| 10 | 60 | 0.351 | 2.5 | 7.1 | 427 |
| 10 | 65 | 0.354 | 2.5 | 7.1 | 459 |
| 10 | 70 | 0.351 | 2.5 | 7.1 | 499 |
| 10 | 90 | 0.420 | 2.5 | 5.6 | 536 |
| 10 | 95 | 0.543 | 2.5 | 4.6 | 473 |
| 10 | 100 | 0.489 | 2.5 | 5.1 | 511 |
| 10 | 102.5 | 0.576 | 2.5 | 4.3 | 445 |
| 10 | 105 | 0.513 | 2.5 | 4.9 | 512 |
| Avg. | | | | (7.0) | (451) |
| 11 | 20 | 0.258 | 2.5 | 9.7 | 194 |

Since the resistance shown in Tables I–VI comprises only the weight 18 attached to the bat 24 by the cable 16, and does not include the weight of the bat 24, the calculated values of the power, and to some extent the speed, are deliberately low and conservative.

While certain specific embodiments and details have been disclosed to illustrate the present invention, it will be clear to one skilled in the art that many modifications may be made therein without departing from the basic concept of the invention. For example, the weights used to offer resistance to a bat swing could be replaced by a spring or springs of various tensions or stiffness, to produce an equivalent result. Moreover, the machine and method could readily be programmed for input-/output by means of a computer chip, microprocessor, computer, or other electronic hardware/software. All such modifications which do not depart from the basic concept of the invention are deemed to lie within the scope of the present invention.

I claim:

1. A method for training a baseball trainee, comprising the steps of:

(a) providing a baseball training bat (b) simulating the ideal swing of said baseball bat by providing a constant restraining force to said bat and a totally straight bat restraining path along which the bat must travel as it is held and swung by a trainee; and (c) communicating to the brain of a trainee the muscular sensations felt by a trainee during the simulated ideal swing; said path along which said bat must travel being defined by a horizontally, totally and entirely straight, rigid, elongated member to which said bat is rotatably and slidably connected by connecting means.

2. A method for training a baseball trainee, comprising the steps of:

(a) simulating the ideal swing of a baseball bat by providing a constant restraining force to the bat and a totally straight bat restraining path along which the bat must travel as it is held and swung by the trainee; and (b) communicating to the brain of the trainee the muscular sensations felt by the trainee during the simulated ideal swing;

the path along which the bat must travel being defined by (c) providing a horizontal first straight, rigid, elongated member;

(d) slidably and rotatably mounting on the first rigid elongated member a kinetic adapter providing freedom of movement, both linear and rotational, in three dimensions and in an infinite number of planes;

(e) providing a training bat comprising a second straight, rigid, elongated member having first and second ends, the first end being constructed and arranged to serve as a handle for the trainee; and (f) connecting the second end of the second rigid elongated member to the kinetic adapter.

3. The method of claim 1, further comprising the step of:

(c) repeating steps (a) and (b) until the ideal swing has become habitual.

* * * * *